United States Patent [19]

Trimborn

[11] Patent Number: 5,009,782

[45] Date of Patent: Apr. 23, 1991

[54] LIQUID SEPARATOR INTEGRATED INTO A PRESSURE CHAMBER HOUSING ABUTTING A LIQUID RING PUMP

[75] Inventor: Peter Trimborn, Nuremberg, Fed. Rep. of Germany

[73] Assignee: Siemens Aktiengesellschaft, Berlin & Munich, Fed. Rep. of Germany

[21] Appl. No.: 500,085

[22] Filed: Mar. 27, 1990

[30] Foreign Application Priority Data

Apr. 11, 1989 [EP] European Pat. Off. ..... 89106359.6

[51] Int. Cl.[5] ..... B01D 45/14

[52] U.S. Cl. ..... 210/360.1; 210/512.3

[58] Field of Search ..... 417/68, 69; 418/DIG. 1, 418/97–99, 100; 55/437, 467, 442, 329, 337, 459.1–459.5, 460, 467; 210/360.1, 360.2, 750, 780, 512.1, 512.3

[56] References Cited

U.S. PATENT DOCUMENTS 4,853,002 8/1989 Niedzwieki et al. ..... 210/750

*Primary Examiner*—Frank Sever

*Attorney, Agent, or Firm*—Kenyon & Kenyon

[57] ABSTRACT

A liquid separator integrated into a pressure chamber housing abutting a liquid ring pump comprises a deflector that subdivides space within the pressure chamber housing into two chambers. A discharge port provided in the pressure control disk leads into a first chamber. A gas outlet and at least one liquid outlet are arranged in the region of a second chamber on the pressure chamber housing. Improved liquid separation is achieved with fewer flow losses. The deflector has a curved design which extends through an angle of at least 180°. The portion of the deflector abutting the control disk extends generally in the direction of the gas-liquid current emerging out of the discharge port.

12 Claims, 2 Drawing Sheets

LIQUID SEPARATOR INTEGRATED INTO A PRESSURE CHAMBER HOUSING ABUTTING A LIQUID RING PUMP

BACKGROUND OF THE INVENTION

The present invention relates to a liquid ring pump utilizing a liquid separator integrated in an abutting pressure chamber housing.

The prior art discloses a related liquid ring pump utilizing separation structure (DE-OS 34 21 866, which corresponds to U.S. Pat. No. 4,710,105). In this prior art device, a deflector forming part of the liquid separator is designed as a baffle facing the discharge port against which the gas-liquid mixture issuing from the discharge port strikes. Added wall sections disposed above and behind the deflector bring about additional sharp deflections of the flow mixture. During these deflections, the heavier liquid particles are separated from the gas particles, since, due to their greater mass inertia, the liquid particles rebound off the deflector and off the added wall sections. The liquid particles then flow downwards into two chambers formed by the deflector in the abutting pressure chamber housing. This repeated deflection of the flow mixture requires that the wall sections be disposed appropriately. From an engineering standpoint, this entails a pressure chamber housing form which is difficult to produce. In addition, such sharp deflections of the flow also cause considerable flow losses and necessitate a device of considerable overall length.

Hence there remains a need for a liquid separator for a liquid ring pump that will provide enhanced liquid separation with fewer flow losses, by means of an adjacent pressure chamber housing which is simpler to manufacture.

SUMMARY OF THE INVENTION

In accordance with the present invention, a low-loss rotational movement is imparted to the flow mixture by means of a curved deflector, while the kinetic energy of the gas-liquid mixture issuing from the discharge port is utilized to advantage. As a result of the centrifugal force that occurs, the heavier liquid particles are hurled against the deflector and flow off towards the bottom. The gas particles, however, can escape through appropriate outlet orifices. In the case of a cyclonic (i.e., rotational) movement, the gas particles are concentrated toward the center of the deflector, so that the gas liberated from the liquid particles is advantageously carried away in the center of the region of the curved deflector. Consequently, flow losses are kept very low.

The position of the deflector enhances the rotational movement of the gas-liquid mixture. The deflector extends so that its curved edge lies near the pressure control disk while allowing for a pass-through port; its opposite end likewise abuts the pressure control disk.

By providing a liquid ring pump with a gas outlet arranged in the center of the circular deflector, the liquid outlet can also be arranged in this center. This can be accomplished by using two tubes that are joined one into the other, in such a manner that the inner tube projects axially from the outer one. The inner tube thus serves to remove the gas, whereas the liquid can run off through the shorter, outer tube. The two tubes are advantageously joined concentrically, one into the other.

DETAILED DESCRIPTION

Figure 1:
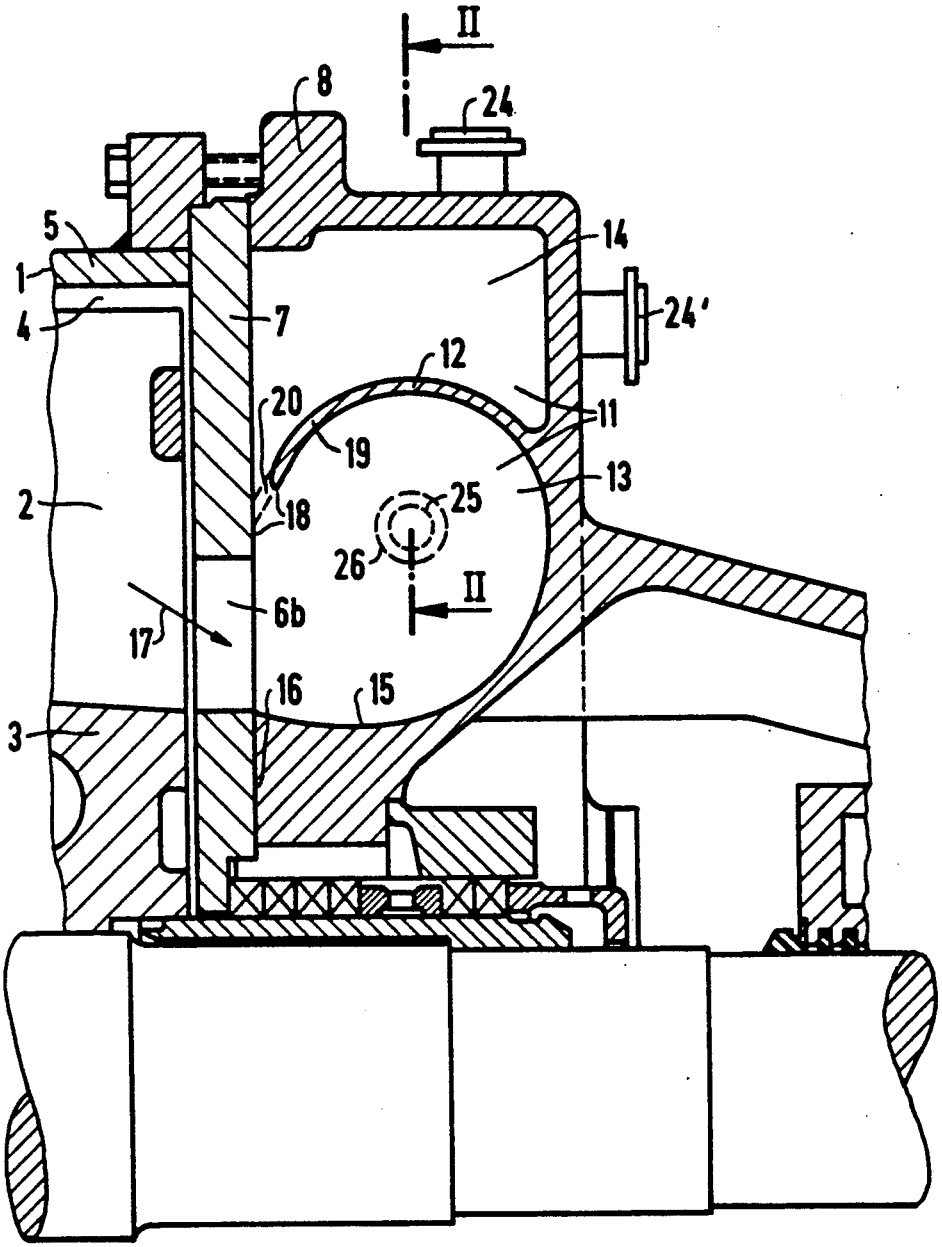
FIG. 1 is a horizontal section view of the pressure chamber housing abutting a liquid ring pump.

A liquid ring pump 1 includes a pump rotor 3 provided with rotor blades 2 in a pump chamber 4 of a pump housing 5. Pump rotor 3 is arranged eccentrically with respect to the housing axis. The pump chamber 4 is sealed at least on one side by means of a control disk 7 provided with suction and discharge ports **6*a* and 6*b*. A pressure chamber housing 8 attached to the pump housing 5 overlaps the control disk 7. In the pressure chamber housing 8, a suction chamber 10 and a pressure chamber 11 are delimited from each other by a segment 9 in a generally known way. Provided within the pressure chamber 11, which is formed in the chamber housing 8, is a curved, preferably circular, deflector 12, that subdivides the pressure chamber 11 into inner and outer chambers 13 and 14. The deflector 12 is designed so that it runs with its one side 15 towards the discharge port 6*b* of the control disk, abutting at lateral edge 16 of this side 15 on the control disk 7. Thus the deflector 12, in connection with the control disk 7, is directed approximately parallel to the gas-liquid current (arrow 17) as it leaves the discharge port 6*b* in the axial direction. As it moves further along the deflector, the gas-liquid current is shifted by means of the deflector 12 into a rotational movement. As a result of the resulting centrifugal forces, the liquid particles are centrifuged out of the gas-liquid mixture and hurled against the deflector 12. They then flow off, downward, on this deflector. The gas particles, however, move toward a pass-through port 20 located between end 18 of the other side 19 of the deflector 12 and the control disk 7, and arrive via this pass-through port to the outer chamber 14**.

Figure 2:
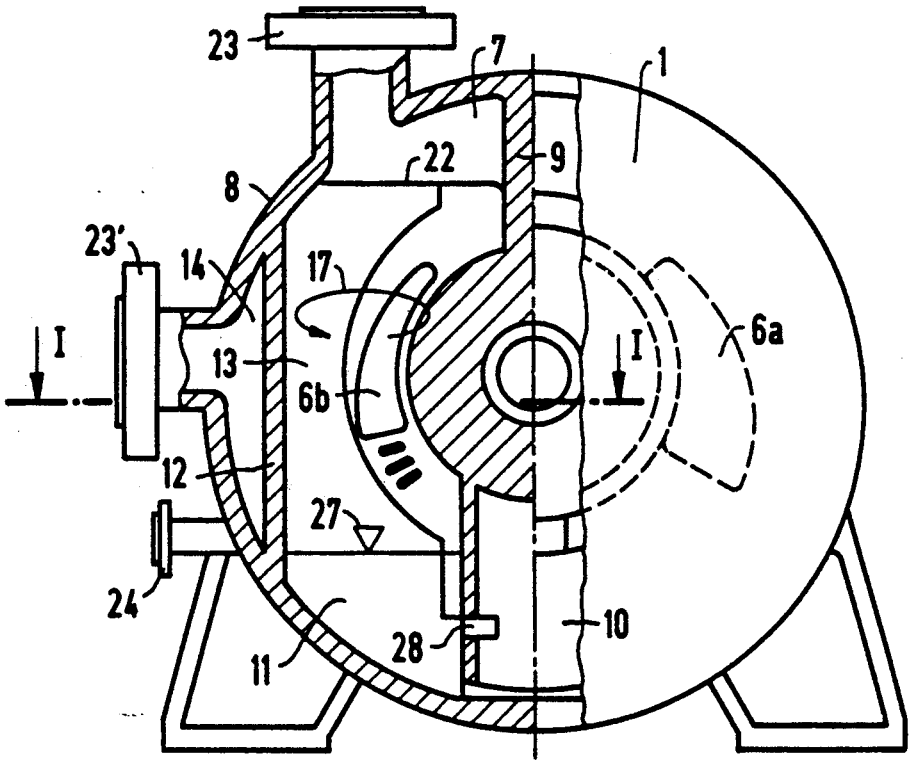
FIG. 2 is a section taken along line II—II of FIG. 1.

On the pressure chamber housing of the liquid ring pump 1 depicted in FIGS. 1 and 2, a discharge stub 23 leading to the outside is provided for the gas and a run-off stub 24 is provided for the liquid. Other possible positions of the discharge and run-off stubs on the chamber housing 8 are indicated at 23' and 24'.

Figure 3:
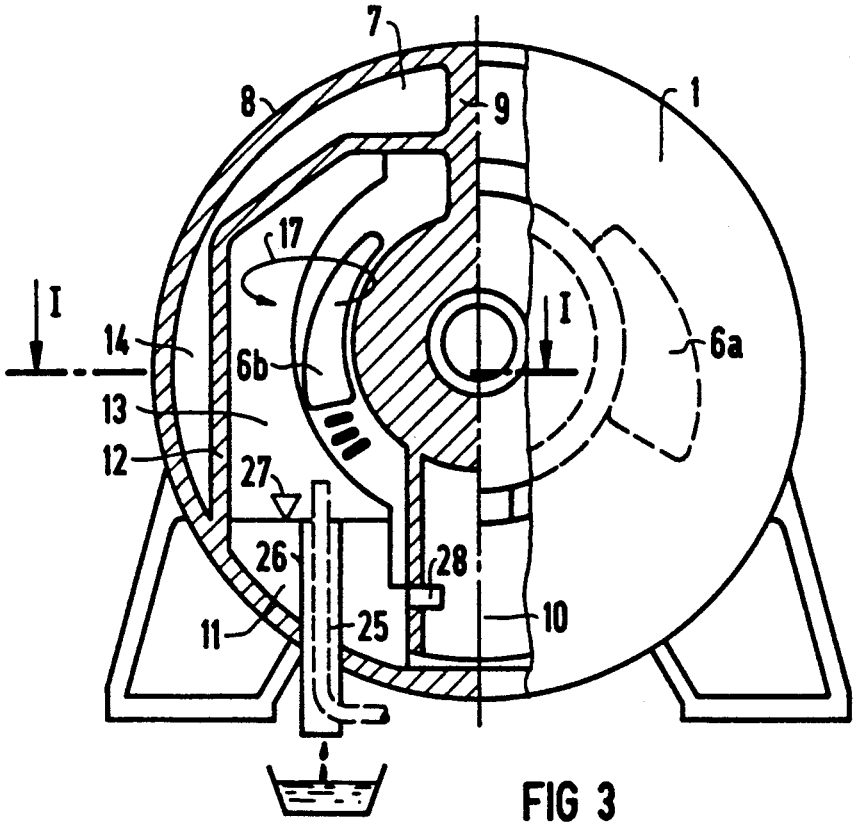
FIG. 3 is a horizontal section view of a second embodiment of the abutting pressure chamber housing of a liquid ring pump.

In the embodiment of the liquid ring pump 1 depicted in FIG. 3, a closed, inner chamber 13 is formed by the deflector 12 in the presSure chamber housing 8. A double tube consisting of an inner tube 25 and an outer tube 26 is arranged along the central axis of the circular deflector 12. The inner tube 25 projects from the outer tube 26 in the axial direction and forms the gas outlet. The liquid separated out of the gas-liquid mixture can flow off through the outer tube 26. The level 27 of the liquid surface in the pressure chamber housing 8 is determined by the end of this outer tube 26. In the case of the liquid ring pump depicted in FIG 1, this liquid surface 27 is determined by the position of the run-off stub 24 on the pressure chamber housing 8. The separated liquid can be conveyed back to the pump circulation again via an opening 28 provided in the segment 9 that separates the suction and pressure chambers 10 and 11.

Due to the formation of the inner chamber 13 that is closed to the top and the arrangement of the gas and liquid outlets (double tubes 25 and 26) in the center of the deflector 12, only very small flow losses result for the gas particles. This is due to the fact that, in their path from the discharge port 6 up to the gas outlet (tube 25), the gas particles retain their rotational movement and thus do not experience any additional, sharp deflection which would lead to losses.

The circular deflector 12 can be modified so that its end 18 at side 19 abuts the control disk 7, as indicated with a dotted line in FIG 1. Thus, the pass-through port 20 is dropped and the outer chamber 14 is no longer functional. The space defined by the deflector 12 can thus comprise the entire discharge-end half of the pressure chamber housing.

In place of the outlet tube 26 arranged in the center, a run-off stub that is brought out laterally from the pressure chamber housing can also be provided, in accordance with the illustration in FIG. 1. It is also possible to combine the two types of outlet designs.

I claim:

1. A liquid separator for a liquid ring pump, the pump having a pressure control disk with an inlet port and a discharge port, comprising:

a pressure chamber housing abutting the pressure control disk, said pressure chamber housing forming an inlet chamber and a discharge chamber, said discharge port leading into said discharge chamber;

means for imparting a cyclonic-type flow movement to a gas-liquid current including a deflector of curved design, in said discharge chamber, having a lateral edge on one side which extends axially in the direction of the gas-liquid current emerging from the discharge port, said deflector abutting the pressure control disk; and a liquid outlet and gas outlet on the abutting pressure chamber housing, with at least the gas outlet being disposed in the approximate center of the region defined by the curved deflector.

2. The liquid separator according to claim 1, wherein the other side of the deflector extends to a position near the pressure control disk, thereby defining a pass-through port.

3. The liquid separator of claim 2, wherein the deflector has a circular design.

4. The liquid separator according to claim 1, wherein the liquid outlet is disposed in the approximate center of the region defined by the curved deflector.

5. The liquid separator according to claim 4, wherein said gas and liquid outlets comprise two concentric tubes each of which opens out into the chamber encircled by the deflector and arranged in the center of the region defined by the curved deflector, the inner tube projecting axially from the outer tube, the outer tube forming the liquid outlet and the inner tube forming the gas outlet.

6. The liquid separator of claim 6, wherein the deflector has a circular design.

7. The liquid separator of claim 4, wherein the deflector has a circular design.

8. The liquid separator according to claim 1, wherein both sides of the deflector abut the pressure control disk.

9. The liquid separator according to claim 8, wherein said gas and liquid outlets comprise two concentric tubes each of which opens out into the chamber encircled by the deflector and arranged in the center of the region defined by the curved deflector, the inner tube projecting axially from the outer tube, the outer tube forming the liquid outlet and the inner tube forming the gas outlet.

10. The liquid separator of claim 9, wherein the deflector has a circular design.

11. The liquid separator of claim 8, wherein the deflector has a circular design.

12. The liquid separator of claim 1, wherein the deflector has a circular design.

* * * * *